US010507969B2

(12) United States Patent
Fang et al.

(10) Patent No.: US 10,507,969 B2
(45) Date of Patent: Dec. 17, 2019

(54) MODULAR CONTAINER

(71) Applicant: Munchkin, Inc., Van Nuys, CA (US)

(72) Inventors: Ruth Hsin-Ju Fang, San Diego, CA (US); Thomas E Birkert, West Hills, CA (US); Mark Gerard Tebbe, Ventura, CA (US)

(73) Assignee: Munchkin, Inc., Van Nuys, CA (US)

( * ) Notice: Subject to any disclaimer, the term of this patent is extended or adjusted under 35 U.S.C. 154(b) by 83 days.

(21) Appl. No.: 15/904,301

(22) Filed: Feb. 23, 2018

(65) Prior Publication Data

US 2018/0237213 A1 Aug. 23, 2018

Related U.S. Application Data

(60) Provisional application No. 62/462,882, filed on Feb. 23, 2017.

(51) Int. Cl.

| | |
|---|---|
| ***A45C 11/00*** | (2006.01) |
| ***B65D 85/07*** | (2017.01) |
| ***A45C 11/24*** | (2006.01) |
| ***A61J 17/00*** | (2006.01) |

(52) U.S. Cl.
CPC ..... *B65D 85/07* (2018.01); *A45C 11/24* (2013.01); *A61J 17/008* (2015.05)

(58) Field of Classification Search
CPC ..... B65D 85/07; A61J 17/008; A45C 11/24
USPC ..... 206/37, 38, 527, 546, 800; 220/4.24, 220/23.2, 23.4, 254.1–254.3, 255, 315, 220/826, 833
See application file for complete search history.

(56) References Cited

U.S. PATENT DOCUMENTS

| | | | | |
|---|---|---|---|---|
| 2,138,916 | A * | 12/1938 | Gaess | A24F 15/20 206/265 |
| 3,317,076 | A * | 5/1967 | Enders | A45C 5/00 220/840 |
| 3,670,875 | A * | 6/1972 | Jones | G03B 21/321 206/408 |
| 3,784,046 | A * | 1/1974 | Cata | A45C 11/24 220/826 |
| 6,926,137 | B2 * | 8/2005 | Rudnick | B65D 43/26 206/15.3 |
| 2004/0155038 | A1 * | 8/2004 | Smith | B65D 33/02 220/9.2 |
| 2009/0166243 | A1 * | 7/2009 | Cetera | A61J 1/03 206/528 |
| 2015/0028034 | A1 * | 1/2015 | Bodmer | B65D 43/168 220/281 |
| 2015/0076168 | A1 * | 3/2015 | Barbier | B65D 43/162 220/826 |

* cited by examiner

*Primary Examiner* — Luan K Bui
(74) *Attorney, Agent, or Firm* — Robert Z. Evora, Esq.

(57) ABSTRACT

A low profile, modular container is described having two cylindrical compartments which connect together at a center portion. The ends of each compartment include a pair of pivoting jaws which are adapted to open to accommodate a pacifier within the body of each compartment.

18 Claims, 4 Drawing Sheets

SECTION 5A-5A

SECTION 6A-6A

MODULAR CONTAINER

CROSS REFERENCE TO RELATED APPLICATIONS

This application claims priority to U.S. Provisional Patent Application Ser. No. 62/462,882, filed Feb. 23, 2017; the content of which is hereby incorporated by reference herein in its entirety into this disclosure.

TECHNICAL FIELD

The subject disclosure relates generally to the field of containers. In particular, the subject disclosure relates to modular containers for housing a small object, such as a pacifier.

BACKGROUND

Caretakers of infants or toddlers often find themselves having to carry many infant products when they travel. It is easy for smaller objects to get lost or misplaced in a travel bag or suitcase when transporting an infant of toddler. An organizational strategy is often very helpful in allowing caretakers to more quickly access a specific object when it is needed.

Pacifiers are one of the most commonly used tools by parents worldwide to ease the stress or anxiety of an infant or toddler. Although pacifiers have many shapes and configurations, the common features include a nipple portion which is inserted into the mouth of the infant or toddler, and a base portion, which supports the base of the nipple portion and rests on the outside of the infant's or toddler's mouth. Although extremely useful, the odd configuration of the standard pacifier creates a bulky geometry which makes them somewhat awkward to carry if not in use. Further, most pacifiers do not have their own container therefore resulting in having to carry a pacifier without a protective housing which would expose the nipple to various contaminants.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

In one exemplary embodiment, the present subject disclosure is a modular container for storing a pacifier. The container includes a first compartment having a first end and connected to a first pair of pivoting jaws at a second end; a second compartment having a first end and connected to a second pair of pivoting jaws at a second end; wherein the first end of the first compartment and the first end of the second compartment are adapted to connect together to create an elongated container having a pair of pivoting jaws at each end.

In another exemplary embodiment, the present subject disclosure is a modular container for storing a pacifier. The container includes a first compartment having a first end and connected to a first pair of lockable pivoting jaws at a second end; a second compartment having a first end and connected to a second pair of lockable pivoting jaws at a second end; wherein the first end of the first compartment and the first end of the second compartment are adapted to connect together to create an elongated container having a pair of pivoting jaws at each end.

In yet another exemplary embodiment, the present subject disclosure is a modular container for storing a pacifier. The container includes a first compartment having an oval cross section and a first end and connected to a first pair of lockable pivoting jaws at a second end; and a second compartment having an oval cross section and a first end and connected to a second pair of lockable pivoting jaws at a second end; wherein the first end of the first compartment and the first end of the second compartment are adapted to connect together to create an elongated container having a pair of pivoting jaws at each end; wherein when the two pairs of jaws are closed, there are no external sharp edges on the pacifier.

While various aspects, features, or advantages of the subject disclosure are illustrated in reference to modular containers, such aspects and features also can be exploited in various other container configurations.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1A:
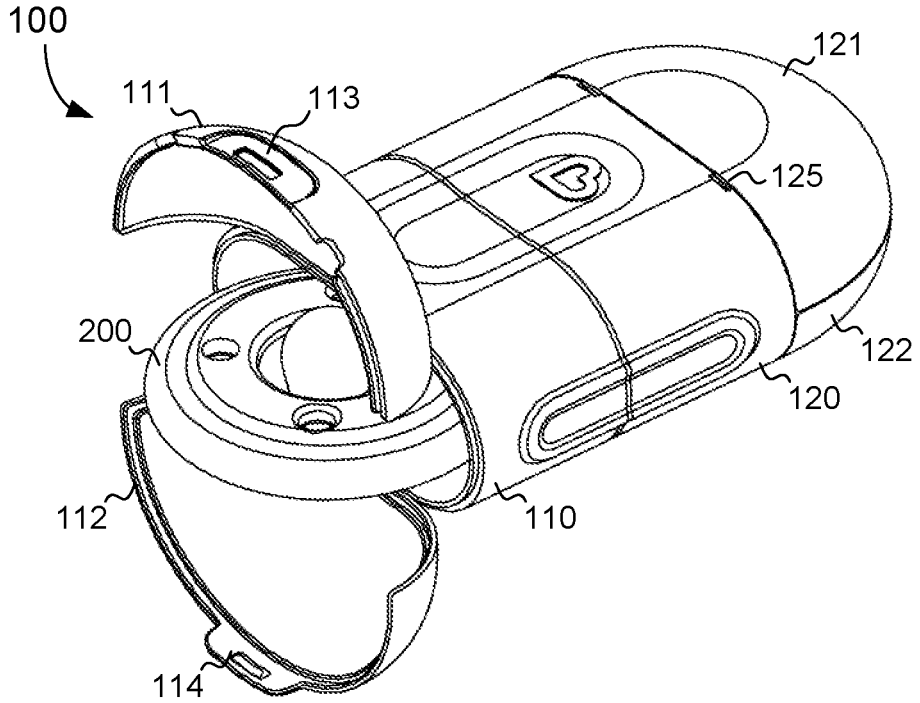
FIG. 1A illustrates a perspective view of an opened modular container housing a compressible pacifier, according to an exemplary embodiment of the present subject disclosure.
Figure 1B:
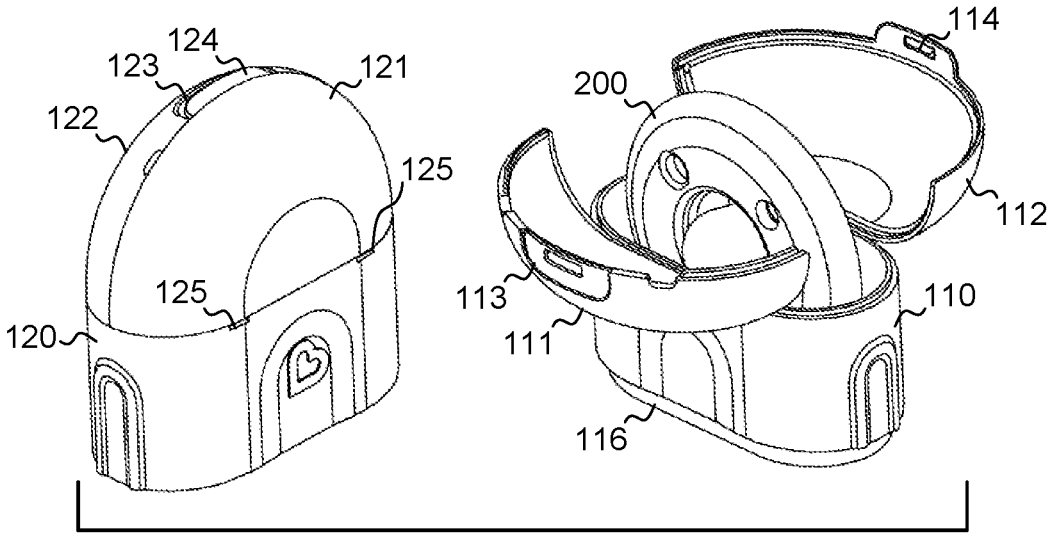
FIG. 1B illustrates an exploded perspective view of an opened modular container housing a compressible pacifier, according to an exemplary embodiment of the present subject disclosure.

Particular embodiments of the present subject disclosure will now be described in greater detail with reference to the figures. As shown in FIGS. 1A-1B, an exemplary embodiment of the present subject disclosure is a modular container 100 having two or more compartments, which are shown as first compartment 110 and second compartment 120. Each compartment 110, 120 has a low profile oval shaped cross section which allows it to store a compressible pacifier 200 therein. Further, no external surface sharp edges are used to prevent possible injury to a user if she is fishing for the container 100 in a large bag or other container with limited visibility. As shown in FIG. 1B, the two compartments 110 and 120 are completely separable and can each accommodate and house one (or more) individual pacifiers 200. One or more apertures (not shown) in the body structure of each compartment 110, 120 allows for any moisture from the interior of the container 100 or on the pacifier 200 to easily evaporate to the ambient environment, thereby decreasing the opportunity for mold or bacterial growth within the container 100.

Compartment 110 has a clamshell opening which is created by two jaws 111 and 112, extending from the cylindrical body portion of compartment 110. The jaws 111, 112 pivot about one or more hinges 115 which connect the jaws to the oval, cylindrical body portion of compartment 110. The jaws 111 and 112 are lockable with respect to each other using a snap lock, button, friction fit, or other locking technique. As shown in the figures, a locking component 114 on jaw 112 has a projection which locks into a complementary aperture in locking component 113 of jaw 111.

Compartment 120 has a similar set of features as that described with respect to compartment 110. For example, compartment 120 includes jaws 121 and 122 which pivot about one or more hinges 125, and lock together using a mechanism which is similar to that described with respect to jaws 111 and 112, but with the locking component 124 on jaw 121 having a projection which locks into an aperture in locking component 123 of jaw 122. Thus, the top jaws 111 and 121 have opposite locking components than their complementary bottom jaws 112 and 122, respectively. In other words, as shown in the exemplary embodiments, the projections 114 and 123 are on the bottom jaw 112 of compartment 110 and top jaw 121 of compartment 120, respectively. One reason this is done is to provide an easy open component no matter which way the container 100 is turned so that there is no real top or bottom side of the modular container 100. The locking components may also be positioned so that they open from the same side, namely projections 114 and 124 are both positioned on the top jaws 111 and 121 or both positioned on the bottom jaws 112 and 122. A combination of two or more different locking mechanisms may also be used and is within the purview of the present subject disclosure.

A projection 116 on the end portion of the compartment 110, away from the jaws 111, 112, is designed to fit within the corresponding interior portion 126 of compartment 120 in order to lock the two compartments 110 and 120 together, as will be described in more detail below.

A set of one or more hinges 115 is positioned between the jaws 111, 112 and compartment 110. Further, a set of one or more hinges 125 is positioned between the jaws 121 and 122 and compartment 120. This ensures that each jaw of either compartment is moveable independently of any other jaw.

Figure 2A:
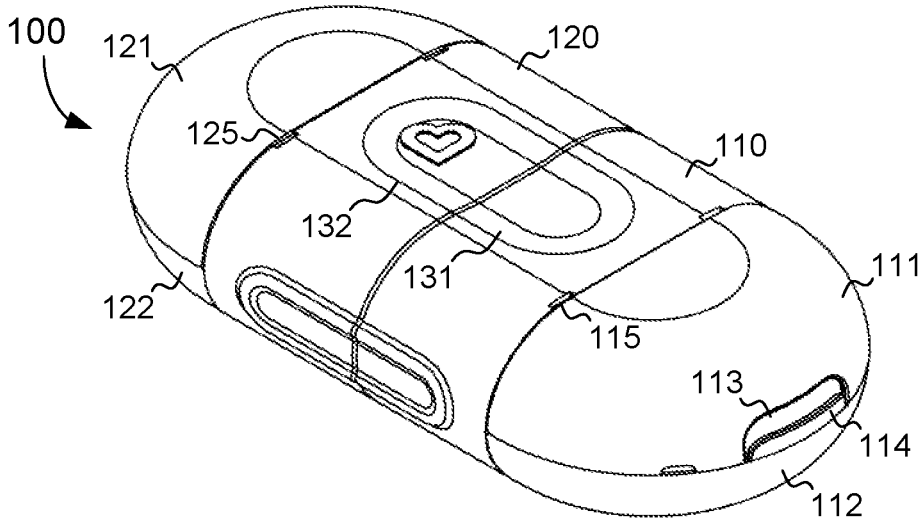
FIG. 2A illustrates a perspective view of a closed modular container, according to an exemplary embodiment of the present subject disclosure.
Figure 2B:
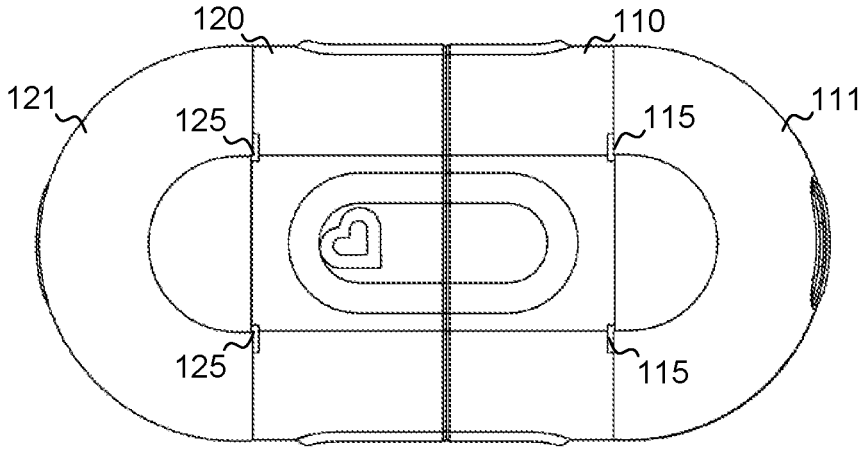
FIG. 2B illustrates a top view of a closed modular container, according to an exemplary embodiment of the present subject disclosure.
Figure 2C:
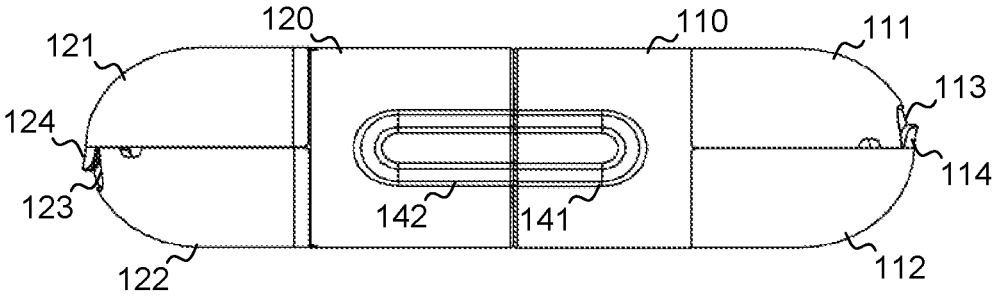
FIG. 2C illustrates a side view of a closed modular container, according to an exemplary embodiment of the present subject disclosure.

FIGS. 2A-2C show the modular container 100 in the closed position from a perspective, top, and side views, respectively. It should be noted that an extending visual indicator, design, color scheme, and/or emblem may be used on the top 131/132 and/or side 141/142 of the modular container 100 to help the user orient compartment 110 and compartment 120, respectively. Alternatively, compartment 110 may be connected to compartment 120 in any orientation, as further described below.

Figure 3B:
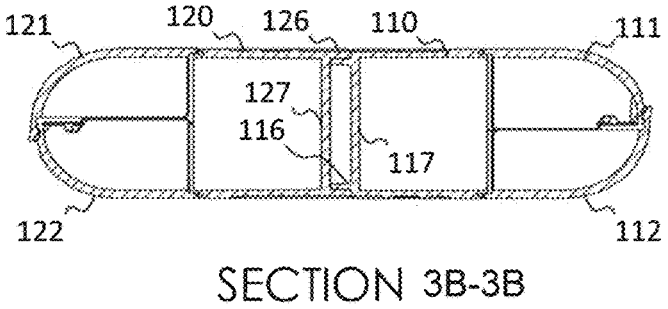
FIG. 3B illustrates a side cut view of an empty modular container at planar cut 3B-3B, according to an exemplary embodiment of the present subject disclosure.
Figure 3A:
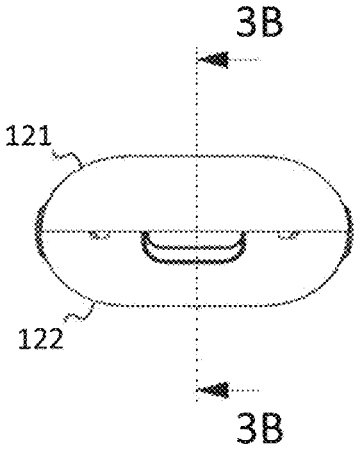
FIG. 3A illustrates an end view of a modular container with planar cut 3B-3B, according to an exemplary embodiment of the present subject disclosure.

As shown more clearly in the cross sectional cut along plane 3B-3B in FIGS. 3A and 3B, compartment 110 is slideable and lockable with respect to compartment 120 using friction fit, a locking joint, moveable button or other similar mechanisms using complementary components 116 and 126, on the first compartment 110 and second compartment 120, respectively. There are no limitations as to whether the top jaws 111 and 121 have to be facing the same top side of the modular container 100 or whether they can be on opposite sides (top/bottom) of the modular container 100. As long as the complementary components 116 and 126 can mate between compartment 110 and compartment 120, then the two compartments may be connected and joined into one unit.

Further, each compartment 110, 120 may be used independently without having to connect to another compartment because each may be a closed container when its respective jaws are closed. Optionally (not shown), there may be small apertures in the bottom portions 117, 127 of each compartment 110, 120, respectively, which allows a fluid connection between the two compartments when they are adjoined.

Figure 4B:
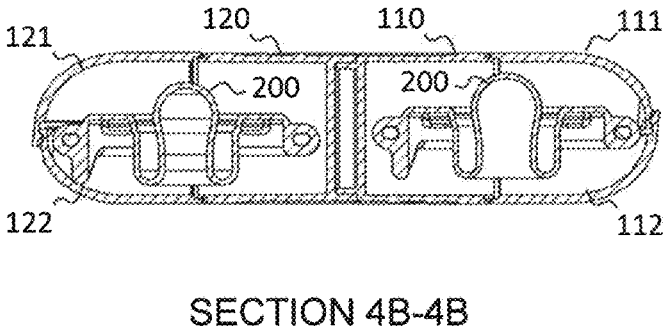
FIG. 4B illustrates a side cut view of a modular container housing two compressed pacifiers at planar cut 4B-4B, according to an exemplary embodiment of the present subject disclosure.
Figure 4A:
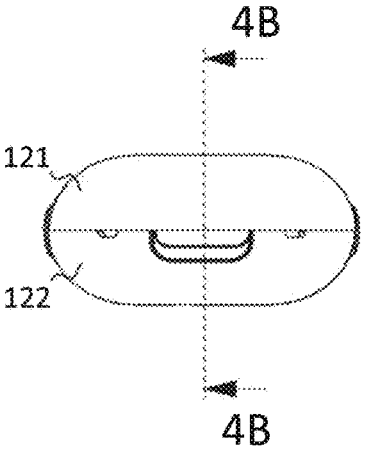
FIG. 4A illustrates an end view of a modular container with planar cut 4B-4B, according to an exemplary embodiment of the present subject disclosure.
Figure 5A:
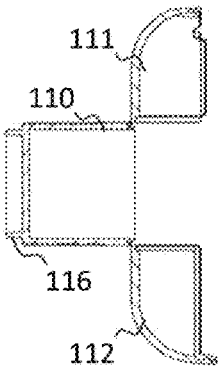
FIGS. 5A-5D illustrate side cut view, end view with planar cut 5A-5A, top view, and side view, respectively, of the open jaws of a first portion of a modular container, according to an exemplary embodiment of the present subject disclosure.
Figure 5B:
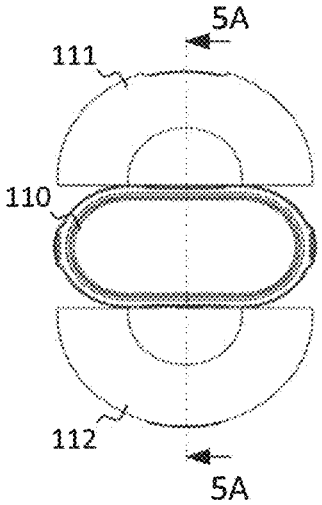
Figure 5C:
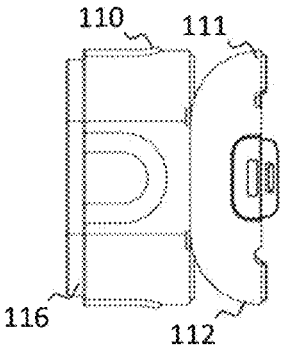
Figure 5D:
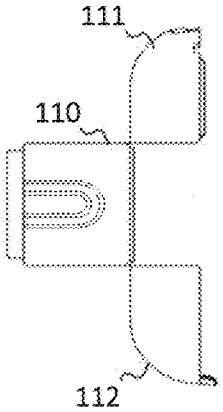
Figure 6A:
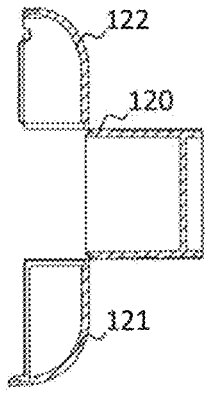
FIGS. 6A-6D illustrate side cut view, end view with planar cut 6A-6A, top view, and side view, respectively, of the open jaws of a second portion of a modular container, according to an exemplary embodiment of the present subject disclosure.
Figure 6B:
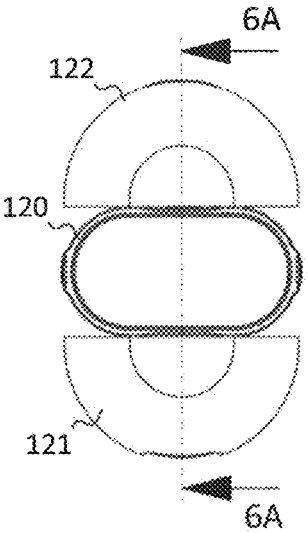
Figure 6C:
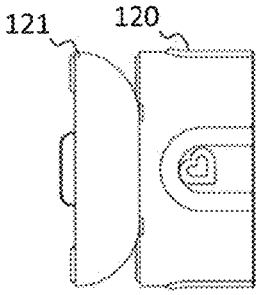
Figure 6D:
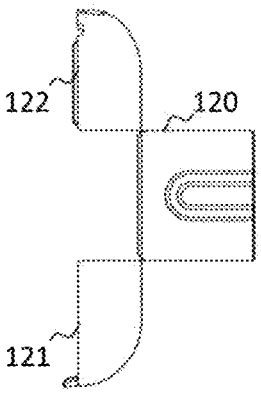

FIGS. 4A-4B illustrate the cross sectional (plane 4B-4B) position of two compressible pacifiers 200 which are being stored in compartments 110 and 120. It should be noted that although no fluid access is shown between the two pacifiers, small apertures or other open channels (not shown) may be used to allow for the fluid interaction between the two compressible pacifiers 200. Further, the bottom portions 117, 127 may be completely open to allow a larger internal volume when the two compartments 110 and 120 are joined together.

FIGS. 5A-5B and 6A-6D illustrate a series of open jaws figures of the two compartments 110 (FIG. 5 series) and 120 (FIG. 6 series) in four views, namely side cut view in plane 5A-5A (and plane 6A-6A), end view, top view, and side view, respectively. They are being presented to show further detail of the mechanism of operation and configuration of the modular container, as described above.

The present subject matter may be used to store or transport low profile and/or compressible pacifiers or other small tools, particularly for use in infant or toddler care. The ability to house and transport a compressible pacifier 200 as described in the present disclosure is desirable as it allows for easier storage and handling of these necessary infant products, particularly because a parent may have several to a dozen or more pacifiers 200 to carry or transport along with the infant. The less space they occupy, the easier they will be to transport.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A modular container, comprising:

a first compartment having a first end and connected to a first pair of pivoting jaws at a second end;

a second compartment having a first end and connected to a second pair of pivoting jaws at a second end;

wherein the first end of the first compartment and the first end of the second compartment are adapted to connect together to create an elongated container having a pair of pivoting jaws at each end.

2. The modular container of claim 1, wherein each pair of jaws is adapted to lock together.

3. The modular container of claim 2, wherein a first jaw in each pair of pivoting jaws includes a projection which mates with a complementary aperture in a second jaw in each pair of pivoting jaws.

4. The modular container of claim 1, wherein the first pair of pivoting jaws are connected to the first compartment pivot about a first set of hinges.

5. The modular container of claim 1, wherein the second pair of pivoting jaws are connected to the second compartment about a second set of hinges.

6. The modular container of claim 1, wherein each pair of jaws forms a clamshell opening.

7. The modular container of claim 1, wherein each compartment is adapted to store a compressible pacifier.

8. The modular container of claim 1, wherein each compartment includes an aperture to allow for evaporation of moisture from within the compartment.

9. The modular container of claim 1, wherein the connection between the first end of the first compartment and the first end of the second compartment includes a friction fit.

10. The modular container of claim 1, wherein each compartment has an oval cross section.

11. The modular container of claim 1, wherein when the two pairs of jaws are closed, there are no external sharp edges on the modular container.

12. The modular container of claim 1, further comprising a visual indicator spanning across an outer surface of the first compartment and the second compartment to visually assist in connecting the compartments together in its intended position.

13. A modular container for storing a pacifier, comprising:

a first compartment having a first end and connected to a first pair of lockable pivoting jaws at a second end;

a second compartment having a first end and connected to a second pair of lockable pivoting jaws at a second end;

wherein the first end of the first compartment and the first end of the second compartment are adapted to connect together to create an elongated container having a pair of pivoting jaws at each end.

14. The modular container of claim 13, wherein each pair of jaws forms a clamshell opening.

15. The modular container of claim 13, wherein each compartment is adapted to store a compressible pacifier.

16. The modular container of claim 13, wherein a first jaw in each pair of jaws includes a projection which mates with a complementary aperture in a second jaw in each pair of pivoting jaws.

17. The modular container of claim 13, wherein when the two pairs of jaws are closed, there are no external sharp edges on the pacifier.

18. A modular container for storing a pacifier, comprising:

a first compartment having an oval cross section and a first end and connected to a first pair of lockable pivoting jaws at a second end; and a second compartment having an oval cross section and a first end and connected to a second pair of lockable pivoting jaws at a second end;

wherein the first end of the first compartment and the first end of the second compartment are adapted to connect together to create an elongated container having a pair of pivoting jaws at each end;

wherein when the two pairs of jaws are closed, there are no external sharp edges on the pacifier.

* * * * *